United States Patent [19]

Pettibone

[11] 4,153,097

[45] May 8, 1979

[54] SKIRTING SUPPORT SYSTEM

[76] Inventor: Hugh G. Pettibone, 4441 Mockingbird Ln., Dallas, Tex. 75205

[21] Appl. No.: 813,349

[22] Filed: Jul. 6, 1977

[51] Int. Cl.[2] ..... A47H 1/00

[52] U.S. Cl. ..... 160/330

[58] Field of Search ..... 24/81 T, 243 K; 248/73, 248/221.3, 221.4, 226.5; 108/152; 160/330, 369, 392

[56] References Cited

U.S. PATENT DOCUMENTS

| | | | |
|---|---|---|---|
| 1,069,134 | 8/1913 | Hatzfeld | 24/81 T |
| 2,104,261 | 1/1938 | Landau | 160/393 |
| 2,491,755 | 12/1949 | Muench | 160/330 |
| 2,491,756 | 12/1949 | Muench | 160/330 |
| 2,541,971 | 2/1951 | Thies | 160/369 |
| 3,115,182 | 12/1963 | Bobbitt | 160/330 |
| 3,643,288 | 2/1972 | Olivari | 24/243 K |
| 3,654,674 | 4/1972 | Abner | 24/243 K |
| 3,808,610 | 5/1974 | Mortensen | 160/349 |
| 3,905,414 | 9/1975 | Guebert et al. | 160/330 |
| 3,958,788 | 5/1976 | Feibelman | 248/307 |

*Primary Examiner*—Peter M. Caun

*Attorney, Agent, or Firm*—Richards, Harris & Medlock

[57] ABSTRACT

A skirting support system for mounting a skirt to a peripheral edge of an article of furniture in accordance with the invention includes a plurality of resilient clips. Each of the clips includes a face portion having outer and inner surfaces. First fasteners are disposed at the outer surface of the clip face portions. Each of the clips further includes upper and lower extentions, transversely intersecting the face portion. A flexible elongate track member having upper and lower portions and a centrally disposed slot adapted to receive the upper extension of the clips is provided to be attached to the peripheral edge of the article of furniture. The track member is flexible to conform to the contour of the article along the peripheral edge. Each of the clips engages the track member, such that the lower track portion is disposed between the clip extension and abuts against the clip face inner surface while the upper clip extension engages the centrally disposed slot of the track member. Skirting includes second fasteners for detachably coupling to the first fasteners of the plurality of clips. The skirting is coupled to the track member such that the clips and fasteners are hidden from view by the upper portion of the track member.

6 Claims, 7 Drawing Figures

SKIRTING SUPPORT SYSTEM

BACKGROUND AND SUMMARY OF THE INVENTION

This invention relates to decorative skirting systems, and more particularly to a skirting connector clip and support system for removably attaching skirts and trimmings to tables, elevated platforms and other articles of furniture.

On many occasions, hotels, restaurants and other institutions often require that banquet tables, temporary stages or elevated platforms have some type of drapery or skirting. This skirting is normally secured or coupled in some manner to the top of the table or platform and hangs therefrom. The skirting ordinarily hangs from the surface of the table to a location adjacent the floor to create a pleasing decorative effect.

Various types of apparatus and techniques have been previously employed to secure or attach skirting. Such apparatus is described and claimed in U.S. Pat. No. 3,905,414 to Guebert et al., issued Sept. 16, 1975, and entitled "Drapery Connector Assembly", and U.S. Pat. No. 2,528,848 to Weinzimmer, issued Nov. 7, 1950 and entitled "Skirt and Curtain Supporting Construction". Other techniques commonly employed to secure a skirt are to directly tack, staple or pin the skirting to the table or platform. This, however, may result in damage to the drapery and to the surface to which it is stapled. This technique is also inconvenient and time consuming for applying, removing and interchanging the skirt. Furthermore, many platform stages or tables commonly employ metallic surfaces to which the draper cannot be stapled.

Prior skirting support systems, employing clips to fasten the skirt to an edge of a table, suffer from the disadvantage in that the clips are attached to the top surface of the table and are therefore visible on the surface of the tablecloth. This arrangement detracts from the overall pleasing decorative effect of the skirting. Furthrmore, the clips can become dislodged due to the presence of articles on the table abutting against the clips. In addition, the skirts usually include a nylon webbing across the upper edge to which fasteners are attached for mating with the clip attached to the table edge. This nylon webbing is also visible at the edge of the table and further detracts from the overall decorative effect of the skirting.

The present invention comprises a novel skirting support system which overcomes the disadvantages that have characterized the prior art. Thus, the preferred embodiment of the invention comprises a skirting support system which fastens to the peripheral edge of a table or other article of furniture in which clips are employed that do not extend over the surface of the table. Furthermore, the skirting is attached to the peripheral edge of a table such that the nylon webbing along the upper edge of the skirt is not visible when viewed from the surface of the table. The system thereby enhances the overal decorative effect of the skirting by hiding from view the support clips and other elements necessary to attach the skirting to the table edge.

In accordance with the broader aspects of the invenion, a skirting support system for mounting a skirt to a peripheral edge of an article of furniture comprises a plurality of resilient clips including first fasteners. A flexible elongate track member having upper and lower portions and a centrally disposed slot adapted to receive the plurality of clips is provided. The track member is flexible to conform to the contour of the article along a peripheral edge. Each of the clips clamp to the lower portion of the track member. The system further includes skirting including second fasteners for detachably coupling to the first fasteners of the plurality of clips, such that the clips and fasteners are hidden from view by the upper portion of the track member.

In accordance with a more specific aspect of the present invention, a skirting support system for mounting a skirt to a peripheral edge of an article of furniture comprises a plurality of resilient clips. Each of the clips includes a face portion having outer and inner surfaces. First fasteners are disposed at the outer face surface of the clip face portion. Each of the clips further includes upper and lower extensions, transversely intersecting the face portion. The system further includes a flexible elongate track member having upper and lower portions and a centrally disposed slot adapted to receive the upper extension of the clips. The track member is flexible to conform to the contour of the article along the peripheral edge. Each of the clips engages the track member, such that the lower track portion is disposed between the clip extensions and abuts against the clip face inner surface, while the upper clip extension engages the centrally disposed slot of the track member. Skirting is provided which includes second fasteners for detachably coupling to the first fasteners of the plurality of clips. The clips and fasteners are hidden from view by the upper portion of the track member.

In accordance with another aspect of the present invention, a skirting support system for mounting a skirt to a peripheral edge of an article of furniture includes skirting having an elongate strip attached to the upper end thereof. A flexible elongate cylindrical core member is disposed between the skirting and the elongate strip, and is substantially affixed to the skirting by the elongate strip. A flexible elongate track member provided having upper and lower portions. The track member is flexible to conform to the contour of the article along the peripheral edge. The track member further includes a centrally disposed slot adapted to receive the core member to detachably fasten the skirt to the track member, such that the elongate strip is substantially hidden from view by the upper portion of the track member.

DESCRIPTION OF THE DRAWINGS

A more complete understanding of the invention may be had by referring to the following detailed description when taken in conjunction with the accompanying drawings, in which.

DETAILED DESCRIPTION

Figure 1:
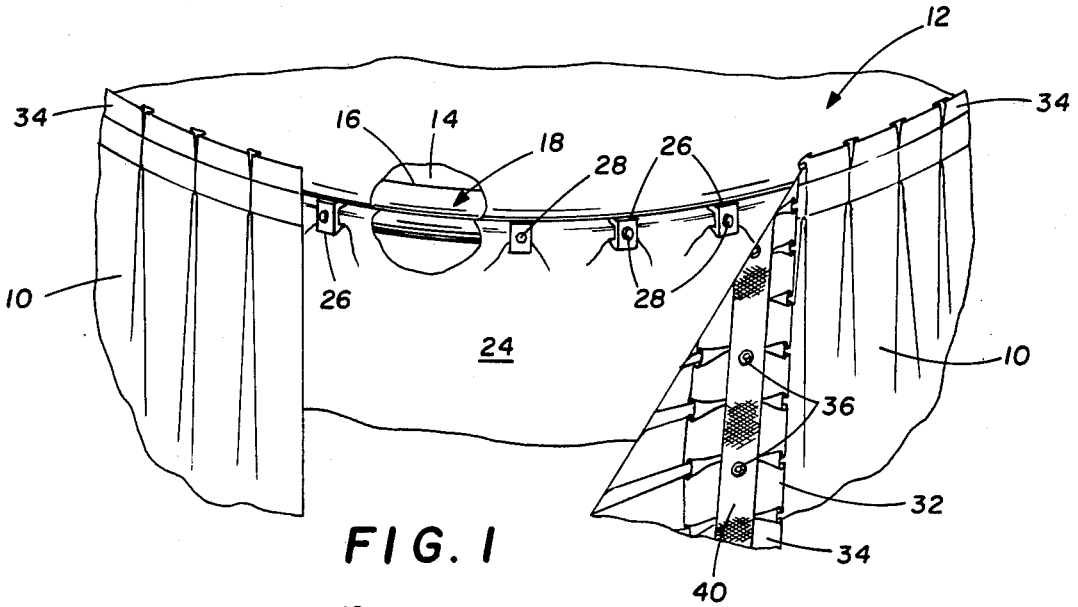
FIG. 1 is a perspective view of the skirting support system of the present invention for attaching skirting to a table.

Referring now to the drawings, and particularly to FIG. 1 thereof, the skirting supporting system of the present invention is illustrated for hanging skirting 10 from a banquet table 12. The use of the terms "skirt" or "skirting" throughout this description generally means, and is intended to include, any type of drape or drapery, curtains, trimming or the like formed of any type of material or fabric used for decorating or enhancing the appearance of the item to which it is coupled. Generally, the material is arranged in loose folds or pleats. While the table 12 has been illustrated as being generally circular, it is understood that the present system can be utilized on a table of any desired configuration, such as rectangular, semi-circular or the like. Furthermore, while the use of the present system is illustrated in FIG. 1 for skirting a table, this is representative of one of the many uses of the present system. Other uses include, for example, the skirting of permanent and temporary raised platforms or stages, as well as other articles of furniture.

The table 12 includes a top surface 14 and a peripheral edge 16. Disposed and spaced along the peripheral edge 16 of the table top surface 14, and securably attached thereto is a flexible elongate track member, generally identified by the numeral 18. The track member 18 is flexible, such that it will conform to the contour of the article being skirted along the peripheral edge of the article. The track member 18 may be extruded from a soft vinyl plastic material, ethyl cellulose or other plastic compositions suitable for continuous use. A tablecloth 24 is positioned on the table top surface 14 and overhangs the peripheral edge 16 of the table 12 and the track member 18. The tablecloth 24 is secured to the track member 18 through the use of a plurality of holders or clips 26, which are removably coupled to the track member 18. Clips 26 include a fastener 28 to which the skirt 10 is secured, in the manner to be subsequently described. The clips 26 are of any desired number or spacing and are firmly, but removably, coupled to the elongate track member 18, and if desired, can be slidably translated therealong.

The skirt 10 includes a top skirt edge 32 and a decorative ruffle 34, which extends above the top surface 14 of the table 12. Also disposed along and adjacent the top skirt edge 32 of the skirt 10 are fastener members 36. Fasteners 36 are adapted to matably engage and detachably couple with the fasteners 28 of the clips 26, to thereby enable the securing of the skirt 10 to the peripheral edge 16 of the table 12. The fastener members 36 may be attached or secured to the skirt 10 in any manner. However, in accordance with the present invention, the fasteners 36 are permanently attached to the skirt 10 by being joined to an elongate strip or web 40. Web 40 may be secured to the skirt 10 in any suitable or appropriate manner, such as by sewing. The web 40 may be fabricated, for example, from a woven nylon tape approximately 1 to 2 inches in width.

Figure 2:
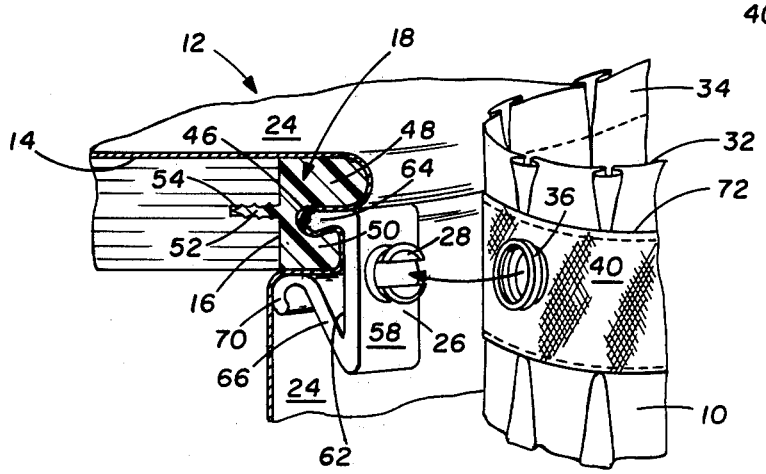
FIG. 2 is a perspective view of a first embodiment of the present skirting support system.

Referring to FIG. 2, wherein like numerals are utilized for like and corresponding elements, the track member 18 is illustrated, and is affixed to the peripheral edge 16 of the table 12. Centrally disposed on the track member 18 is a slot 46, which defines an upper portion 48 and a lower portion 50 of the track member 18. The track member 18 further includes a serrated spline 52, which is inserted into a saw kerf 54 within the peripheral edge 16 of the table 12 to affix the track member 18 to the table 12.

Figure 3:
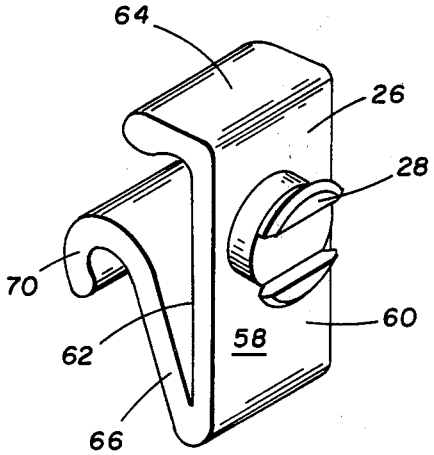
FIG. 3 is a perspective view of the resilient clip shown in FIG. 2.

Referring simultaneously to FIGS. 2 and 3, the resilient clip 26 is illustrated. Clip 26 includes a face portion, generally identified by the numberal 58, having an outer face surface 60 and an inner face surface 62. Upper and lower extensions 64 and 66 transversely intersect the face portion 58 of the clip 26. The upper and lower extensions 64 and 66 resiliently engage the track member 18 in the manner illustrated in FIG. 2. The upper extension 64 is adapted to be received by the central slot 46 of the track member 18, while the lower extension 66 of the clip 26 having a curved end portion 70 abuts against the lower surface of the lower portion 50 of the track member 18. It therefore can be seen that the lower portion 50 of the track member 18 is disposed between the upper and lower extensions 64 and 66 of the resilient clip 26, such that the upper portion 48 of track member 18 is in substantial alignment with the outer face surface 60 of the face portion 58 to conceal the resilient clip 26 from view when viewed from the top surface 14 of the table 12. FIG. 2 also illustrates the securing of the tablecloth 24 by the resilient clip 26. The tablecloth 24 is trapped within the central slot 46 of the track member 18 by the upper extension 64 of the resilient clip 26. This configuration holds the tablecloth 24 in a stretched wrinkle free position on the table top 14.

The resilient clip 26, and particularly the upper and lower extensions 64 and 66 are formed from a resilient plastic material, for example, polycarbonate, and can be fabricated, for example, by injection molding. The fastener 28 disposed on the outer face surface 60 of the face portion 58 can be integrally molded to the resilient clip 26. Alternatively, the fastener 28 may comprise, for example a metallic fastener, which is mechanically affixed to the face portion 58 of the resilient clip 26.

While the resilient clip 26 may be formed from any shape or size, it is preferably formed in the shape illustrated in FIG. 3. Specifically, the lower extension 66 is angularly disposed at an angle of approximately 45 degrees to the face portion 58. This configuration assists the resilient clamping action against the lower portion 50 of the track member 18. The clip 26 is fabricated so that the overall height of the face portion 58 is such as to allow the clip 26 to clamp onto track members of varying widths. Alternatively, the angle of intersection of the lower extension 66 to the face portion 58 can be varied to allow for variations in the width of the peripheral edges of the article being skirted.

Referring again to FIG. 2, it can be seen that the upper edge 72 of the nylon web 40 is disposed well below the table top surface 14 of the table 12 when the fastener 36 engages the fastener 28 of the resilient clip 26. Therefore, the nylon web 40 is hidden from view when the skirting 10 is viewed from above the table top 14 to provide an aesthetically pleasing skirt.

Although the fastener 28 has been shown as a male connector and fastener 36 as a female connector, it will be understood that this configuration can be reversed such that the fastener 36 may be a part of the resilient clip 26, and the fastener 28 may be secured to the nylon web 40.

Figure 4:
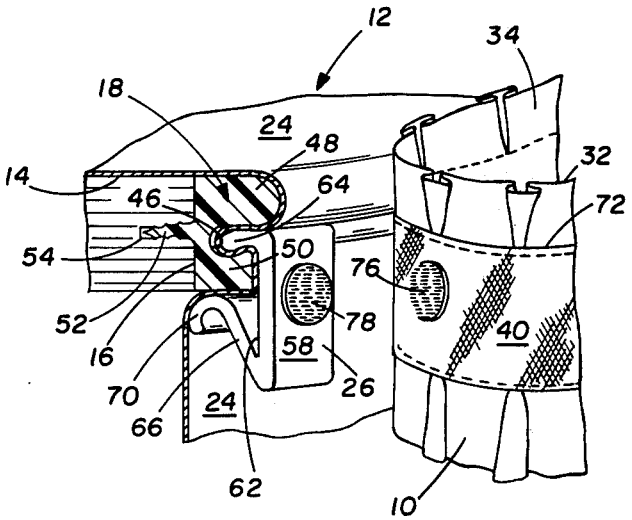
FIG. 4 is a perspective view of a second embodiment of the present skirting support system.

Referring now to FIG. 4, a second embodiment of the present invention is illustrated wherein like numerals are utilized for like and corresponding elements. A piece of fabric 76 of the type sold under the trademark Velcro, which is a pile fabric having the pile loops split or cut for detachable secure fastening to a mating fabric is attached to the nylon web 40 of the skirt 10. A mating piece of Velcro fabric 78 is attached to the resilient clip 26 for fastening to and mating with the Velcro fabric piece 76 of the skirt 10. It therefore can be seen that the Velcro fabric pieces 76 and 78 function similarly to the fasteners 36 and 28 previously described in FIGS. 2 and 3. The fabric piece 76 may be adhesively affixed to the nylon web 40 or sewn thereto. Alternatively, the fabric piece 76 may be a continuous strip of Velcro material extending throughout the entire length of the nylon web 40 along the length of the skirt 10. The fabric piece 78 may be adhesively affixed to the resilient clip 26 or in the alternative, mechanically affixed thereto.

Figure 5:
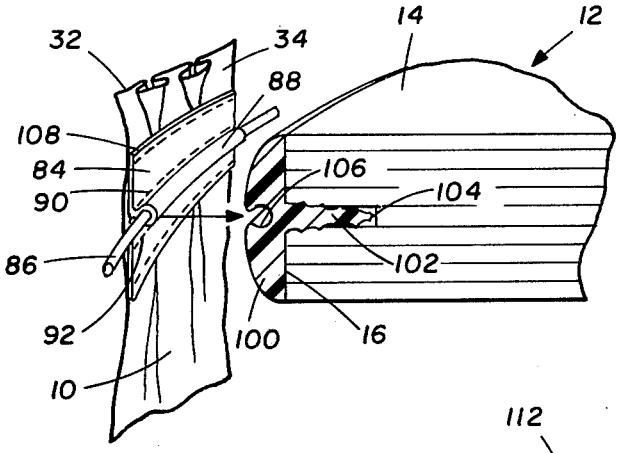
FIG. 5 is a side elevation view of a third embodiment of the present skirting support system.

Referring to FIG. 5, a third embodiment of the present invention is illustrated. The skirt 10 includes a nylon web strip 84, which is attached to the top skirt edge 32 of the skirt 10. Disposed between the web 84 and the skirt 10 is an elongate cylindrical core member 86. The core member 86 may be fabricated from extruded soft vinyl plastic, and is flexible to conform to the peripheral edge of the article to be skirted. Core member 86 is affixed to the web 84 by trapping core member 86 within the loop 88 of the web 84 formed around core 86, and is securedly held therein by stitchings 90 and 92.

FIG. 5 also illustrates a flexible elongate track member 100, which is secured to the peripheral edge 16 of the table 12 using a serrated spline 102 driven into a saw kerf 104. Centrally disposed on the track member 100 is a slot or groove 106, adapted to receive the core member 86 of the skirt 10. To affix the skirt 10 to the peripheral edge 16 of the table 12, the core member 86 is fastened to the track member 100 by insertably pressing the core member 86 into the slot 106. The skirt 10 can be easily detached from the track member 100 by disengaging the core member 86 from the slot 106 of the track member 100. It can be seen in FIG. 5 that the upper edge 108 of the web 84 lies well below the top surface 14 of table 12, such that the web 84 is hidden from view.

Figure 6:
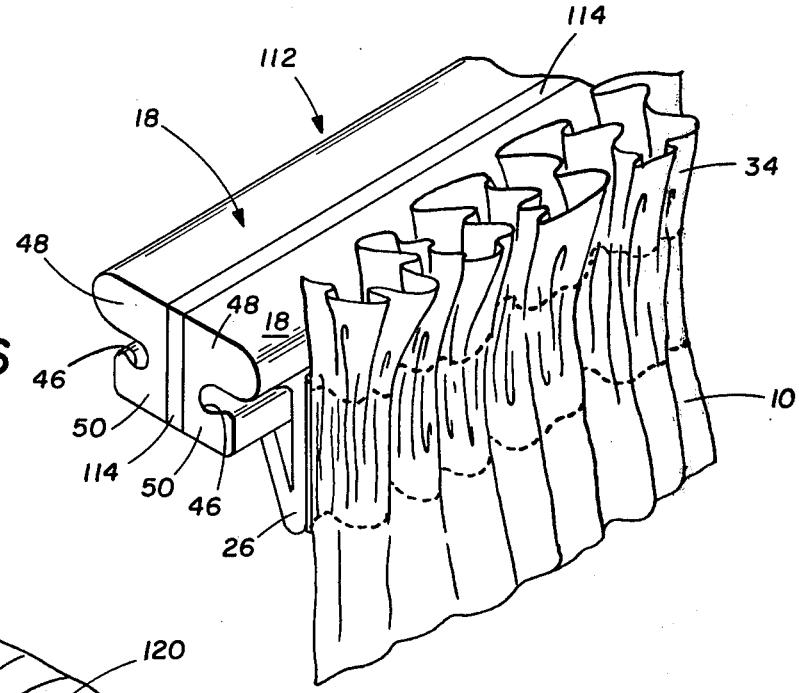
FIG. 6 is a perspective view of a hanger rod utilizing the present skirting support system.

FIG. 6 illustrates a hanger rod generally identified by the numeral 112 for storing skirting when not in use. The hanger rod 112 includes a segment of the track member 18 in which the spline 52 has been removed. The segments of track member 18 are mounted to a bar 114 which provides support for the track members 18. Bar 114 may comprise, for example, aluminum or wood. Bar 114 is then stored within a caddy or other storage facility to house skirtings. The skirting 10 is attached to the track member 18 using the resilient clips 26 as previously described in connection with FIGS. 2 and 3. The use of the hanger rod illustrates in FIG. 6 allows for easy assembly of skirts to a table, in that the stored skirting can be removed along with the clips 26 from the hanger rod track members 18 and directly inserted into the track members 18 of the peripheral edge of a table to be skirted. Similarly, the skirts can be detached from the periphery of a table and then replaced to the hanger rod 112 for storage after use.

Figure 7:
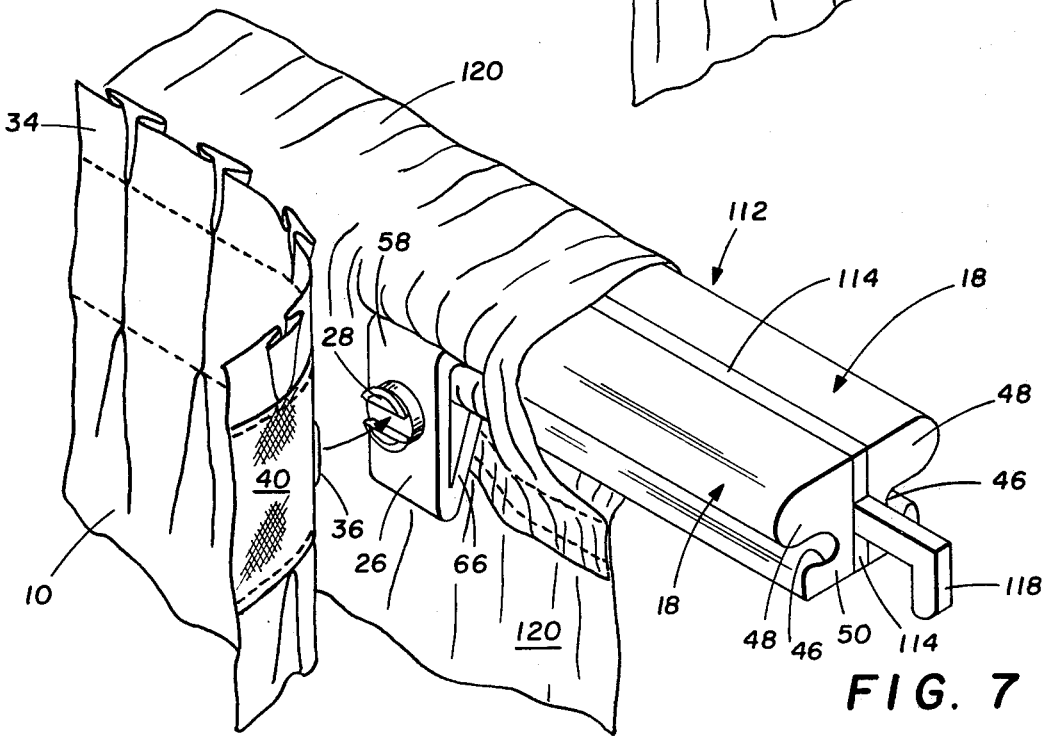
FIG. 7 is a perspective view of the backdrop utilizing the present skirting support system.

FIG. 7 illustrates the use of the present skirting support system for hanging a backdrop, which is typically used to delineate booth space between exhibitors at a convention. Typically, backdrops are hung from supporting frames and provide a common drape for adjacent booths. However, should an exhibitor wish to use a custom drape or one which is more decorative, it is difficult to affix the drape to the existing backdrop. Utilizing the present invention, however, the skirting support system allows a skirt to be affixed to the existing drapery. The hanger rod 112 illustrated in FIG. 6 is equipped with a hook 118, which fits into existing stanchions (not shown) separating booth areas. The existing drapery 120 is supported by the hanger rod 112 as illustrated. The decorative skirt 10 by using the clips 26 can then be affixed to the track member 18 on one side of the hanger rod 112 in the manner previously described in connection with FIGS. 2 and 3.

From the foregoing, it will be understood that the present invention comprises a skirting support system for mounting a skirt to a peripheral edge of an article of furniture. The system enables the efficient mounting of a skirt for convenient, quick application, removal and interchangability of skirts. Furthermore, the system eliminates the viewing of the unsightly fasteners and the web portion of skirts characteristic of existing support systems which detract from the overall decorative effect of skirted tables, platforms and the like.

Although preferred embodiments of the present invention have been illustrated in the drawings, and described in the foregoing specification, it will be understood that the invention is not limited to the embodiments disclosed, but is capable of rearrangement, modification and substitution of parts and elements without departing from the spirit of the invention.

What is claimed is:

1. A skirting support system for mounting a skirt to a peripheral edge of an article comprising:

a plurality of resilient clips, each of said clips including;

a face portion having outer and inner surfaces;

an upper extension having top and bottom surfaces and transversely intersecting said inner surface of said face portion;

a lower extension having top and bottom surfaces, being spaced apart from said upper extension and transversely intersecting said inner surface of said face portion;

said lower extension further including an end member terminating in a curvilinear portion; and first fastener means disposed at said outer surface of said clip face portion;

a flexible elongate track member having upper and lower portions and a centrally disposed elongate slot positioned between said upper and lower portions, said centrally disposed elongate slot having top and bottom surfaces;

said flexible elongate track member being flexible to conform to the contour of the article along the peripheral edge thereof;

means for attaching said flexible elongate track member to the peripheral edge of the article;

each of said plurality of clips frictionally engaging said flexible elongate track member, such that said top surface of said upper extension of said resilient clips engages said top surface of said centrally disposed elongate slot of said flexible elongate track member, said bottom surface of said upper extension of said resilient clips engages said bottom surface of said centrally disposed elongate slot of said flexible elongate track member, said lower portion of said flexible elongate track member engages said inner surface of said clip face portion, said clip lower extension top surface engages said lower portion of said flexible elongate track member; and skirting means including second fastener means for detachably coupling to said first fastener means of said plurality of clips, such that said clips and said fasteners are hidden from view by said upper portion of said flexible elongate track member.

2. The system of claim 1 wherein said clip lower extension is disposed at approximately a 45 degree angle to said inner surface of said clip face portion.

3. The system of claim 1 wherein said second fastener means are disposed along an elongate strip secured to said skirting means.

4. The system of claim 1 wherein said first fastener means comprise male fasteners and said second fastener means comprise female fasteners.

5. The system of claim 1 wherein said fastener means comprise a fabric having split pile loops for releasable holding engagement therebetween.

6. The system of claim 1 wherein the outer surface of said upper portion of said flexible elongate track member aligns with said outer surface of said clip face portion.

* * * * *